United States Patent [19]

Yoshida et al.

[11] Patent Number: 4,558,730

[45] Date of Patent: Dec. 17, 1985

[54] METHOD OF AND APPARATUS FOR CONTINUOUSLY OR SEMI-CONTINUOUSLY CASTING METAL INGOTS

[75] Inventors: Masahiro Yoshida; Susumu Inumaru, both of Nagoya, Japan

[73] Assignee: Sumitomo Light Metal Industries, Ltd., Tokyo, Japan

[21] Appl. No.: 426,137

[22] Filed: Sep. 28, 1982

[30] Foreign Application Priority Data

May 13, 1982 [JP] Japan ..... 57-80596

[51] Int. Cl.[4] ..... B22D 11/00; B22D 11/124

[52] U.S. Cl. ..... 164/487; 164/444; 164/418; 164/138

[58] Field of Search ..... 164/487, 459, 443, 485, 164/418, 138, 486, 444

[56] References Cited

U.S. PATENT DOCUMENTS

| | | | |
|---|---|---|---|
| 2,672,665 | 3/1954 | Gardner et al. | 164/418 |
| 3,441,079 | 4/1969 | Bryson | 164/487 |
| 3,520,352 | 7/1970 | Hess | 164/485 |

FOREIGN PATENT DOCUMENTS

| | | | |
|---|---|---|---|
| 0005825 | 1/1979 | Japan | 164/138 |
| 897252 | 5/1962 | United Kingdom . | |
| 1026399 | 4/1966 | United Kingdom . | |

*Primary Examiner*—Kuang Y. Lin
*Attorney, Agent, or Firm*—Browdy and Neimark

[57] ABSTRACT

A method of continuously or semi-continuously casting an ingot of rectangular cross section in a vertical open-ended direct chill mold having a coolant passageway, wherein a flow of coolant is circulated and discharged from the bottom of the mold, and molten metal poured into the mold is solidified by applying the discharged flow of coolant directly to the peripheral surface of the metal emerging from the bottom of the mold. The method comprises a step of preventing a direct contact of the poured molten metal with an upper part of inner walls of the mold and controlling the cooling of the molten metal by the flow of coolant circulating in the passageway via the inner walls. The above step comprises interposing heat-insulating sheets between the upper part of the inner walls of the mold and the peripheral surface of the poured molten metal within the mold. The heat-insulating sheets are each dimensioned to satisfy predetermined formulas according to casting speed, mold size and other casting conditions such that a central portion of the sheet extends downwardly into the mold to a greater extend than the end portions thereof. An apparatus to practice the above method is also disclosed. The apparatus comprises the heat-insulating sheets which cover an upper part of inner walls of the mold and dimensioned and positioned according to the casting conditions.

10 Claims, 10 Drawing Figures

FIG. 2B
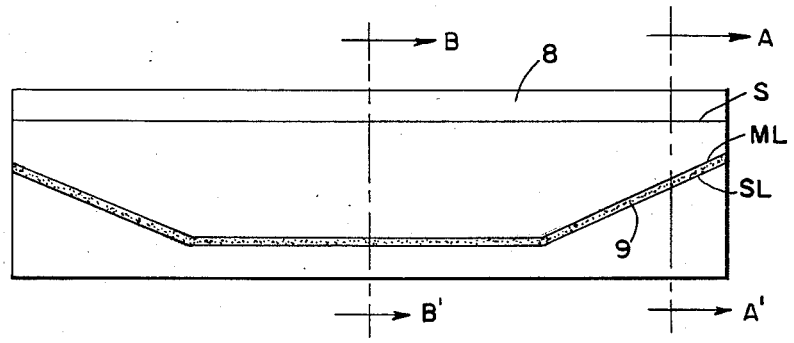
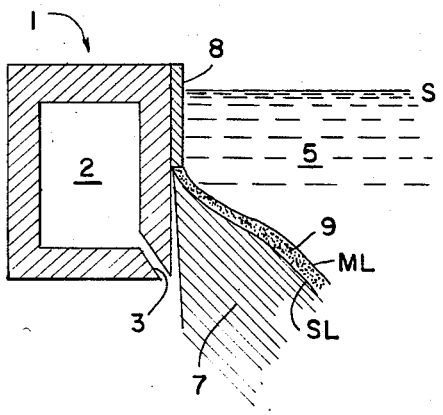
FIG. 2C
FIG. 2D
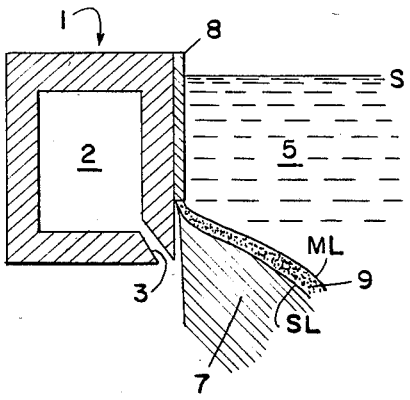

METHOD OF AND APPARATUS FOR CONTINUOUSLY OR SEMI-CONTINUOUSLY CASTING METAL INGOTS

BACKGROUND OF THE INVENTION

The present invention relates to a method of and an apparatus for continuously or semi-continuously casting rectangular metal ingots, and more particularly to a method with which it is possible to produce ingots of rectangular cross section from light metals, particularly aluminum or aluminum base alloys, with consistently high quality.

Numerous methods have been proposed in the art for continuous or semi-continuous casting of metal ingots from metals such as aluminum and aluminum base alloys. A typical example of such methods is disclosed in the U.S. Pat. No. 2,983,972 in which a vertical open-ended casting mold is closed at its lower open end by a stool which initially forms the bottom of the mold but is lowered as molten metal is poured into the mold cavity through a nozzle or a trough. As the stool is progressively lowered in step, a column of liquid metal within the mold initially cooled by contact with the inner wall of the mold which contains a coolant (usually, water) circulating through a passageway formed therein, is then cooled directly by a splash of the coolant delivered through a slit in the lower end of the mold, whereby the liquid metal column is solidified as it emerges from the mold. Thus, the intended solid ingot is continuously formed and withdrawn from the mold.

It has been frequently recognized that the continuous production of metal ingots with such conventional methods may result in ingots having various sorts of surface defects or irregularities which are referred to as "liquation", "cold shuts", "stickings or weldings", etc. Developments of these defects which have adverse effects on the end products (obtained by processing the ingots) need to be reduced to a practical minimum.

It has already been observed that the development of the above surface defects are result from a thin layer of solidification shell in the mold which is formed by a primary cooling thereof with a coolant circulating within the mold to cool the inner wall. In view of this observation, it has been conventionally suggested to prevent formation of such thin weak layer of the solidification shell for the purpose of improving surface quality of the ingots. One of such remedies for removing or reducing the surface defects is the use of a hot top casting process, as typically shown in the U.S. Pat. No. 3,612,151, wherein an insulated feed reservoir is axially aligned with a mold and the casting speed for a metal is established so that the upstream conduction distance measured from the liquid wetting line of the coolant on the ingot surface extends to within about 1 inch of the reservoir, in order to substantially eliminate a thin layer of solidification shell formed within the mold and conduct a casting operation so that only a rigidly solidified metal is formed through direct cooling of the liquid metal (secondary cooling) by the coolant discharged from the bottom of the mold. Another casting process similar to the above hot top process has been proposed, as disclosed in the U.S. Pat. No. 3,326,270, wherein an upper part of the mold wall is covered with a tubular heat-insulating member with its lower end located at a predetermined position on the mold wall so that the front of solidification by secondary cooling (direct chilling) is located just beneath the lower end of the heat-insulating member.

Although it has been recognized that the above conventional solutions to the development of surface defects on the ingot surface are effectively applied to the production of ingots of circular cross section, it has been extremely difficult to apply those solutions to the production of ingots of rectangular cross section with improvements of surface quality as much as attained where the ingots to be produced are circular in cross section. In casting an ingot of rectangular or square cross section, the level or line of solidification by direct chill or secondary cooling is different at different positions on the periphery of the rectangular mold. More specifically, the solidification level is higher at the corners of the inner wall surfaces of the mold than at the central portions between the corners. Therefore, a mere shifting of the level of solidification by a constant amount at all portions of the ingot will not lead to simultaneous elimination of the previously indicated weak brittle layer of solidification shell in the mold from all portions of the ingot adjacent to the inner periphery of the mold. Thus, the mere use of the heat insulators on the inner mold wall has not been successful in attaining consistent improvements in the surface quality over the entire periphery of the ingot.

Whereas, one of the present inventors proposed a method of continuously casting metal ingots, which is the subject matter of the Japanese patent application TOKUGAN-SHO No. 51-91719 (laid open as TOKUKAI-SHO No. 53-16323), in which a suitable open-ended heat-insulating member of rectangular cross section is disposed so as to be interposed between an upper part of the inner mold wall and the outer periphery of molten metal while means for controlling thermal conductivity of the mold wall is provided, in order to eliminate the previously indicated weak brittle layer of solidification shell. The disclosure of the above application clarifies the foregoing problem encountered in the casting of rectangular ingots, i.e., difference in formation of the solidification shell between the central portion of each side of the rectangular cross section of the ingot and the corner portions at the end of each side, and the same disclosure also clarifies that the above problem is favourably solved by the use of a heat-insulating member whose four sides each comprise a central portion which projects downwardly of the mold wall.

However, further analysis and observations of the casting process of rectangular cross sectional ingots by the present inventors dictated that the above proposed heat-insulating member with improved lower end profiles are not completely satisfactory for sufficient improvements in the surface quality and skin structure of the ingots, and clarified that there still exists a problem of difficulty in obtaining a consistent surface finish throughout the periphery of the ingots. Thus, there has been a requirement for further improvement in the process for casting rectangular ingots.

Through intensive research and investigation in view of the above situation, the inventors obtained a finding that the foregoing problems experienced in the art can be more effectively overcome, that is, an ingot of rectangular cross section can be cast with consistently high surface quality throughout the periphery thereof, by means of properly positioning or dimensioning a heat-insulating sheet which is interposed between an upper part of each inner wall surface of the mold and the outer periphery of molten metal. More particularly stated, each of the heat-insulating sheets which prevent direct contact of the poured molten metal with the wall surfaces on four sides of the mold, is adapted such that its central and horizontal end portions covering the respective central and end (corner) portion of each side of the rectangular mold are dimensioned or their lower end profiles are determined to satisfy a predetermined relationship according to casting conditions and specific kinds of metals to be cast, and such that the central portion of the sheet is downwardly projected beyond the adjacent end portions and has a straight lower end profile extending horizontally over a predetermined distance from the center of the respective side of the mold toward the end portions.

SUMMARY OF THE INVENTION

Accordingly, it is an object of the present invention to provide a continuous or semi-continuous casting method and apparatus with which it is possible to produce metal ingots of rectangular cross section with consistent quality.

Another object of the invention is to provide a method of, and an apparatus for, continuously or semi-continuously casting an ingot of rectangular cross section from metals, particularly aluminum and aluminum base alloys, which improves surface finish and skin structure throughout the entire periphery of the cast ingot.

To attain the above objects, a method according to the invention of continuously or semi-continuously casting an ingot of rectangular cross section in a vertical open-ended direct chill mold having a coolant passageway, wherein a flow of coolant is circulated through the passageway and discharged from the bottom of the mold, and wherein molten metal poured into the mold is solidified by applying the discharged flow of coolant directly to the peripheral surface of the metal emerging from the bottom of the mold, comprises the steps of:

preventing a direct contact of the poured molten metal with an upper part of inner walls of the mold, controlling the cooling of the molten metal by the flow of coolant circulating in the passageway via the inner walls, and preventing the direct contact and controlling the cooling comprising interposing heat-insulating sheets between the upper part of the inner walls of the mold and the peripheral surface of the poured molten metal within the mold, the heat-insulating sheets each being dimensioned to satisfy the following formulas such that a central portion thereof extends downwardly into mold to a greater extent than the end portions thereof:

$$0.2 \leqq V \cdot H_1 \leqq 0.7$$

$$\frac{V+0.2}{V} \leqq H_2 \leqq \frac{4V+0.7}{V}$$

$$L-1.2T \leqq L_1 \leqq L-0.6T$$

where,

V = casting speed (cm/sec.), $H_1$ = distance between a lower end of the inner wall and a lower end of the heat-insulating sheet measured vertically of the mold at the central portion of the sheet on each side of the mold (cm), $H_2$ = distance between the lower end of the inner wall and the lower end of the sheet measured vertically of the mold at each corner of the mold (cm), L = length of each long side of the mold (cm), T = length of each short side of the mold (cm), $L_1$ = length of a lower central portion of the inner wall, not covered with the sheet, on the each long side of the mold horizontally extending with a height of $H_1$ from its center toward its end over substantially equal lengths (cm).

An apparatus according to this invention is characterized by the provision of heat-insulating sheets which cover upper parts of the inner wall of the vertical open-ended mold, which heat-insulating sheets are dimensioned to satisfy the above indicated formulas.

According to the method and the apparatus of the invention indicated above, the central and horizontal end (corner) portions of the heat-insulating sheet covering the upper part of each side of the mold are determined in geometry or dimension according to the specific casting speed and other casting conditions whereby the formation of a thin layer of solidification shell in the mold is effectively restrained simultaneously at both central and end portions of the molten metal in contact with the central portion of each side of the mold and the corner portions thereof, and as a result such layer of solidification shell is substantially eliminated. Further, the arrangement of the sheet so as to have the downwardly projected central portion having a lower end profile which extends horizontally over a selected distance, permits effective elimination of the solidification shell in the mold consistently in the direction along the long sides of the mold. The above features of the present method allow optimum, stable and economical operations of casting different sizes of rectangular ingots under different casting conditions while assuring fine and smooth surfaces of the cast ingots.

The rectangular ingots produced according to the present method and apparatus have a consistent surface quality throughout the periphery thereof, and their skin structure is improved to be finer because a layer of coarse crystal grain (sub-surface band: SSB) otherwise formed in the skin is formed only in the extreme skin portion, thereby reducing the quantity of metal which needs to be machined away when the ingot is subsequently processed.

In addition, the casting method and apparatus according to this invention have advantages of reducing shrinkage factors of the ingot thereby providing improved dimensional accuracy thereof, as well as decreasing a cell size of the dendrite structure in the skin layer of up to about 50 mm from the surface.

BRIEF DESCRIPTION OF THE DRAWINGS

The above and other objects, features and advantages will become more apparent from the following description taken in connection with the accompanying drawings in which:

FIG. 2B illustrates the relationship between the liquid line and the solid layer line when the heat insulating sheet of the invention is attached to the mold wall;

FIGS. 2C and 2D are cross-sectional views taken along lines A—A' of FIG. 2B near a mold corner, and along lines B—B' of FIG. 2B at an intermediate portion between mold corners, respectively;

DETAILED DESCRIPTION OF THE INVENTION

Referring more particularly to the accompanying drawings, there will be described the present invention in greater detail.

Figure 1:
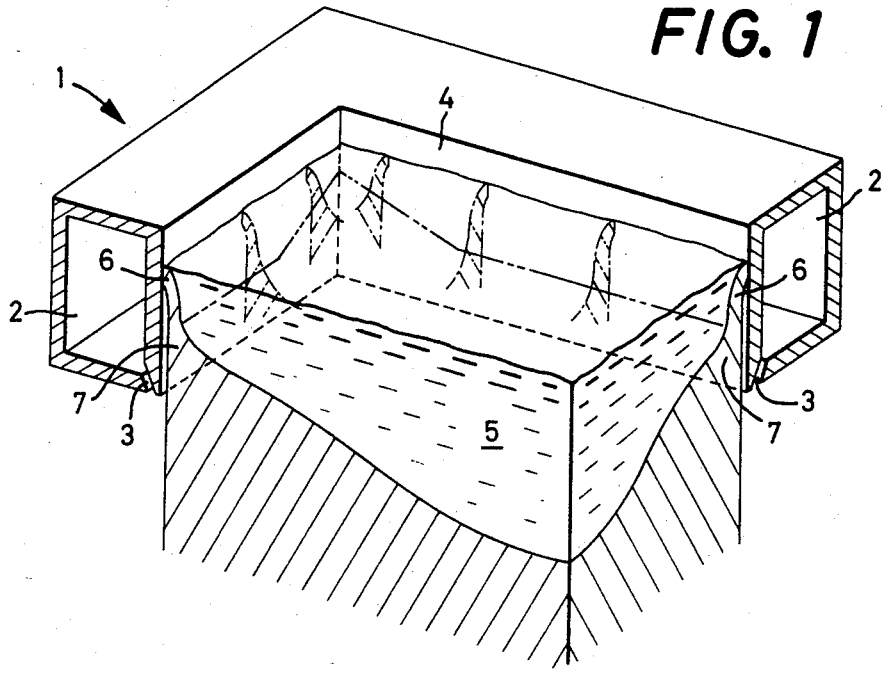
FIG. 1 is a cross sectional perspective view schematically showing a one-fourth corner portion of a vertical open-ended, direct chill continuous casting mold and a solidified metal ingot of rectangular cross section corresponding to the corner portion of the mold.

Referring first to FIG. 1, there are schematically shown in perspective cross section a one-fourth corner portion of a vertical open-ended, direct chill continuous (or semi-continuous) casting mold 1 and a solidified aluminum ingot of rectangular cross section obtained by casting a molten metal 5 into the mold 1. The open-ended casting mold 1 of rectangular cross section is constructed so as to form within the interior a water chamber 2 through which a stream of water serving as a coolant is circulated. The coolant water circulating within the water chamber 2 is discharged out of the chamber 2 through a slit 3 formed in the inner edge at the lower open end or bottom of the mold 1. The molten metal 5 is continuously poured into an internal cavity 4 of rectangular shape defined by the inner wall surfaces of the mold 1, and the poured molten metal 5 is subjected to a primary cooling in contact with the inner wall surfaces of the mold 1 whereby a thin embryonic solidification shell 6 is formed in the mold. The partially solidified metal ingot is withdrawn downwardly from the lower end of the mold 1 and therefore subjected to a direct water cooling (secondary cooling) by a splash of the coolant water supplied through the slit 3 at the bottom of the mold 1, whereby a rigid solidified metal 7 is formed in the direct cooling zone. The completely solidified ingot is taken out downwardly from the mold 1.

In cooling such rectangular cast shape or ingot during formation thereof in the open-ended mold 1 which forms the rectangular internal cavity 4, each corner portion of the cast metal is cooled more than the intermediate portions between the corner portions in the secondary step of cooling directly by the coolant water from the slit 3, and this fact results in the solidified metal 7 being larger in dimension at the corner portions than at the intermediate portions in dimension as measured vertically of the mold 1 or ingot. In other words, the level of the solidified metal 7 is higher at the corner portions than at the intermediate portions as shown in two-dot chain line in FIG. 1, and the above indicated vertical dimension of the embryonic solidification shell 6 is smaller at the corner portions than at the intermediate portions, as also shown in FIG. 1.

Figure 2A:
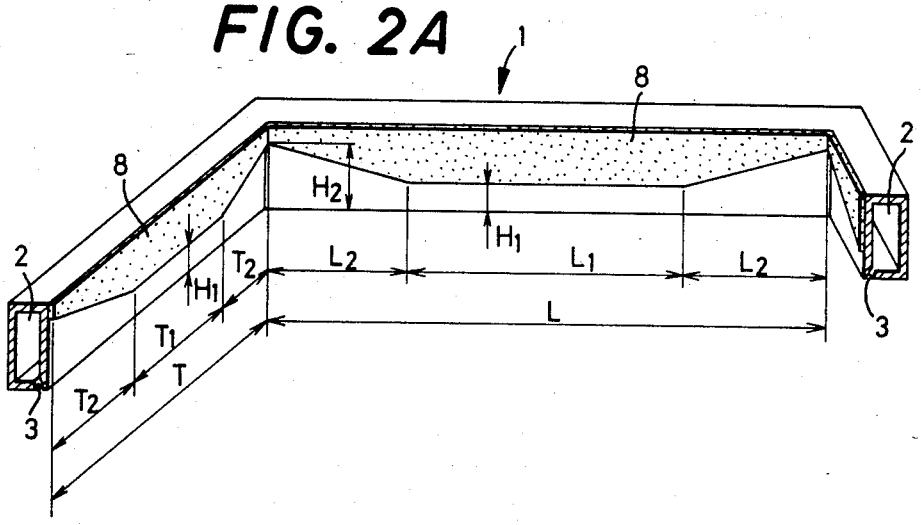
FIG. 2A is a cross sectional perspective view illustrating heat-insulating sheets covering portions of the inner wall surfaces of the mold according to the invention.

Referring next to FIG. 2A, there is shown heat-insulating sheets 8 which control the effect of cooling the molten metal through the inner wall surfaces of the mold 1 by way of covering upper parts of those wall surfaces according to the invention. In other words, the invention is directed to providing the heat-insulating sheets 8 with suitable shapes or dimensions which are selected in view of the data obtained through various fundamental experimentations and actual casting operations, in order to remove a difference in formation of the solidification shells due to varying cooling conditions at different positions of the mold 1, or obtain uniform solidification structures throughout the cast metal ingot, and at the same time restrain the formation of, or substantially eliminate, the solidification shell 6, as well as to obtain improved surface or skin structure of the ingot.

More particularly stated, it was found that the dimensions of the heat-insulating sheets 8 must be determined so that the following formulas (I), (II) and (III) are satisfied:

$$0.2 \leqq V \cdot H_1 \leqq 0.7 \quad \text{(I)}$$

$$\frac{V + 0.2}{V} \leqq H_2 \leqq \frac{4V + 0.7}{V} \quad \text{(II)}$$

$$L - 1.2T \leqq L_1 \leqq L - 0.6T \quad \text{(III)}$$

where,

V = casting speed (cm/sec.), $H_1$ = distance between a lower end of the inner wall and a lower end of the heat-insulating sheet 8 measured vertically of the mold 1 at the central portion of the sheet 8 on each side of the mold 1 (cm), $H_2$ = distance between the lower end of the inner wall and the lower end of the sheet 8 measured vertically of the mold 1 at each corner of the mold 1 (cm), L = length of each long side of the mold 1 (cm), T = length of each short side of the mold 1 (cm), $L_1$ = length of a lower central portion of the inner wall, not covered with the sheet 8, on the each long side of the mold 1 horizontally extending with a height of $H_1$ from its center to its ends over substantially equal lengths (cm).

With the above dimensions determined according to the above formulas, each of the sheets 8 is formed such that the dimension measured vertically of the mold 1 increases from the ends to its central portion so that the lower end of the sheet 8 is inclined or substantially tapered downwardly from the opposite ends of each side of the mold 1. In addition, the central portion of the sheet 8 on the long sides of the mold 1 has a constant vertically measured dimension over the entire length corresponding to $L_1$.

By covering the inner wall surfaces of the mold 1 with the heat-insulating sheets 8 which are dimensioned to satisfy the above formulas, developments of otherwise possible liquation, cold shuts and other surface defects are restrained consistently over the entire surfaces of the solidified cast shape thereby assuring an improved surface finish, i.e., allowing a sound casting of molten metal into a solid ingot having a smooth and highly acceptable surface. The heat-insulating sheets 8 further contribute to improvements in skin structure of the ingot, and reduction in cell size of the dendrite structure and the shirinkage factor.

The heat-insulating sheets 8 covering a part of the inner wall surfaces of the mold 1 to prevent direct contact of the molten metal 5 with the wall surfaces, are normally formed of alumina fibers, glass fibers, carbon fibers, asbestos, plate of an asbestos-silica composition sold under the name "Marinite", or other inorganic fiber materials, and usually have a thickness in a range of 0.5–10 mm. While the values T, L and V in the previous formulas are suitably determined depending upon desired shapes of an ingot and casting conditions, those values are practically selected within the following ranges, respectively: T=300–700 mm, L=500–1600 mm, V=30–100 mm/min. Of course, T is less than L.

Although it is preferred for easier cut of the sheet 8 that the lower end of the sheet 8 at both horizontal end portions thereof adjacent the corners of the mold 1 be tapered downwardly from the corners as shown in FIG. 2 over each of distances $L_2$ (distance from the end of $L_1$ to the corner) so that the vertically measured distance of the corresponding uncovered portion of the wall surface is linearly increased toward the corner from $H_1$ to $H_2$, it is possible to form the sheet 8 such that the above end portions over the distances $L_2$ are suitably curved at their lower end.

Similarly to the sheet 8 on the long sides of the mold 1, the sheet 8 on the short sides has a distance $T_1$ which corresponds to the central portion of the inner wall surface not covered with the sheet horizontally extending from the center of the short side T with the width of $H_1$ toward the corners over substantially the same distances. It is preferred that this distance $T_1$ be selected so as to be substantially one-third ($\frac{1}{3}$) of the length T of the short side. It is also preferred that the lower end of the sheet 8 at both horizontal end portions thereof be tapered from the corners of the mold 1 downwardly over each of distances $T_2$ so that the vertically measured distance of the corresponding uncovered portion of the wall surface is linearly increased toward the corner from $H_1$ to $H_2$. This downwardly tapered arrangement of the sheet 8 on the short sides of the mold 1 is particularly effective when the length T of the short side is not less than approximately 500 mm, but it is possible in some situations that the end portions over the distances $T_2$ are suitably curved at their lower end as long as the distances $H_1$ and $H_2$ are selected within the range of formulas (I) and (II).

Further, it is preferred that the distance $L_2$ of the uncovered portion of the wall surface on the long side of the mold 1 (in which the vertical dimension is increased toward the corner from $H_1$ to $H_2$) be selected so as to be substantially one-half ($\frac{1}{2}$) of the length T of the short side.

As shown in FIGS. 2B–2D, the use of a heat-insulating sheet 8 in accordance with the invention prevents formation of the thin embryonic shell 6. Absent this embryonic shell, the solid line SL of FIG. 2B, which represents the lower end profile of a mashy layer 9 adjacent to the mold wall surface, is congruent with a lower end profile of the heat-insulating sheet 8.

The following examples are given to further clarify this invention; however, these examples are not to be construed to limit the scope of the invention.

EXAMPLE 1

Pure aluminum rectangular ingots were cast semi-continuously in a vertical open-ended direct chill mold having short sides (T) of 500 mm and long sides (L) of 1,080 mm. Some of the ingots were obtained according to a conventional casting method wherein the inner wall surfaces of the mold are not covered with any heat-insulating sheets, and some were produced with the wall surfaces covered with heat-insulating sheets (as shown in FIG. 2) having dimensions and shapes according to the present invention. The heat-insulating sheets used in accordance with the invention are formed of ceramic fibers, having a thickness of 3 mm and the following dimensions: $H_1$=50 mm, $H_2$=70 mm, $L_1$=580 mm, $L_2$=250 mm, $T_1$=$T_2$=167 mm. Each of the sheets is disposed on the inner wall surface to cover a predetermined upper part of the wall surface so that the horizontally end portions of the sheet are tapered downwardly from the ends toward the central portion of the sheet, and thereby prevents a direct contact of the poured molten aluminum with the said upper part of the inner wall surface. The casting operations were conducted at a rate of 55 mm/min.

The comparison of the ingots thus obtained according to the invention with those obtained in the conventional manner revealed that the conventionally produced ingots had liquation and cold shuts over the entire surfaces and consequently a low surface quality. On the other hand, the ingots obtained according to the invention demonstrated consistently smooth, high-quality casting surfaces without any traces of liquations, cold shuts and other surface defects except for minute ripples of less than 3 mm which are inherent in a hot-top casting process.

Figure 3:
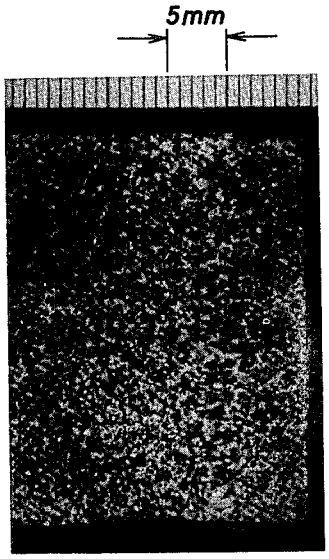
FIGS. 3 and 4 are photomacrographs showing macrostructures across the thickness of skin portions of rectangular ingots obtained in Example 1 according to a prior art method and a method of the invention, respectively.
Figure 4:
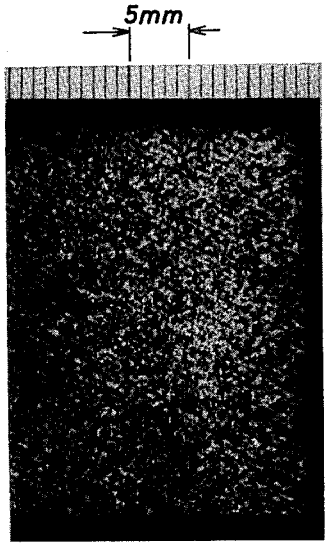
Figure 5:
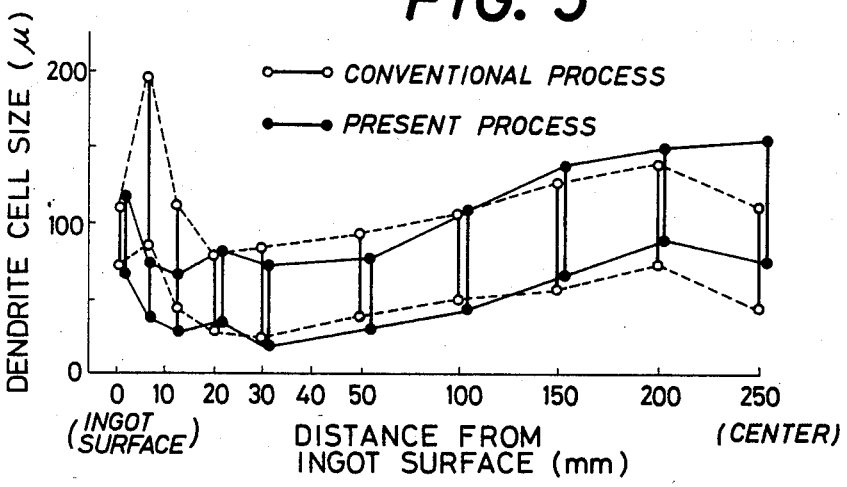
FIG. 5 is a graphical representation showing the distribution of cell sizes of cellular dendrite structures of the rectangular ingots obtained in Example 1 according to the prior art method and the method of the invention.
Figure 6A:
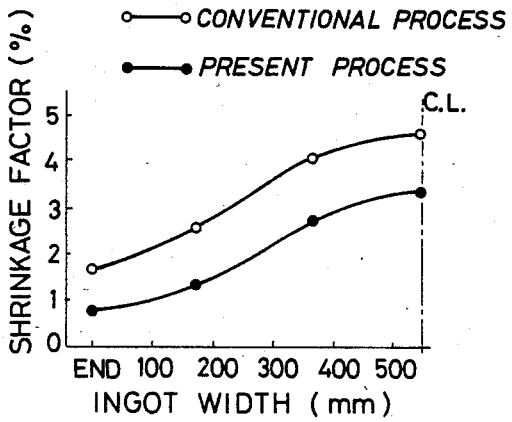
FIG. 6(*a*) and FIG. 6(*b*) are graphical representations showing, variations in shrinkage factor of the head and bottom portions respectively, as measured along the long sides of the mold, of the rectangular ingots obtained in Example 1 according to the prior art and present methods.
Figure 6B:
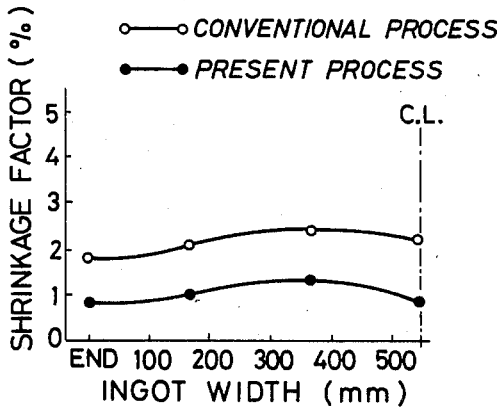

The two groups of ingots thus obtained according to the conventional and present methods, respectively, had: macrostructures across the thickness of their skin portions as shown in the photomacrographs of FIGS. 3 and 4, respectively; variations in cell sizes of cellular dendrite structures in the direction along the short sides of the mold from the ingot surface to the core or center thereof, as shown in FIG. 5; and variations in shrinkage factor of the head and bottom portions of the ingots measured along the long sides of the mold, as shown in FIGS. 6(*a*) and 6(*b*), respectively.

As clearly understood from the photomacrographs of FIGS. 3 and 4, the skin or surface structure of the prior art ingots shown in FIG. 3 has a sub-surface band (SSB) of a coarse structure which exists 8–10 mm inwardly from the casting surface. This is contrary to the sub-surface band (SSB) of the ingots of the invention which has a fine structure and is located in extreme proximity to the casting surface, as shown in FIG. 4. Thus, the present ingots have a reduced quantity of metal which needs to be removed or machined away to get the required surface finish.

As apparently illustrated in FIG. 5, the ingots the invention have a cellular dendrite structure of extremely reduced cell size, in a portion up to about 50 mm depth from the surface, as compared with that of the conventional ingots. Another advantage of the present ingots over the conventional ingots is seen from the graphs of FIGS. 6(*a*) and 6(*b*) which demonstrate that the ingots of the invention have lower shrinkage factors (%) than the conventional ingots at both head and bottom portions thereof.

Another group of ingots were cast with the heat-insulating sheets (on the long sides of the mold) of the present invention replaced with heat-insulating sheets whose lower end profile is curved to be merely vertically downwardly convexed as a whole (while only the dimensions $H_1$ and $H_2$ being kept within the previously indicated ranges). This group of ingots thus obtained exhibited several sweating-outs and cold shuts on the long side surfaces and therefore had a difficulty in providing an improved surface quality, i.e., smooth and neat casting surfaces on all sides of the ingot. The partial development of the sweating-outs and cold-shuts causes an inconsistency in quality in circumferential directions. In consideration of these surface defects, the ingots of this group obtained with the heat-insulating sheets not in accordance with the invention were judged to be equivalent or slightly superior in quality to those obtained according to the prior art method.

EXAMPLE 2

In another case, pure aluminum ingots were cast semi-continuously in a vertical open-ended direct chill mold having short sides (T) of 500 mm and long sides (L) of 1,230 mm. The upper parts of the inner wall surfaces of the mold were covered with different heat-insulating sheets whose dimensions are specified in Table 1 below. The casting operations were carried out at a rate of 50 mm/min.

The evaluated surface qualities of the various ingots obtained with the different heat-insulating sheets are indicated also in Table 1.

TABLE 1

| No. | Dimensions of Insulator Sheets $H_1$ (mm) | $H_2$ (mm) | $L_1$ (mm) | Surface Qualities of obtained Ingots |
|---|---|---|---|---|
| 1 | 20 | 75 | 700 | Considerable cold shuts were found over the entire central portion of the long sides. The surface finish was worse than that with the conventional method. This was supposed to result from the secondary cooling solidification extending above the lower end of the insulator sheets. |
| 2 | 50 | 100 | 700 | Surface defects due to strain were recognized near the corners on the long sides. The surface finish was not better than that of the conventional method, but an improvement was found in the central portion of the long sides. |
| 3 | 50 | 75 | 700 | A very smooth and fine surface was obtained over the entire area on the long sides. |
| 4 | 50 | 75 | 950 | Cold shuts similar to those in No. 1 case were found in portions inward of the corners on the long sides. Other portions had a fairly fine surface quality. |
| 5 | 50 | 75 | 550 | Surface defects similar to those in No. 2 case were recognized in portions between the corners and the center on the long sides. |

The evaluations listed in Table 1 clearly reveal that the use of heat-insulating sheets which are dimensioned to satisfy the conditions of the present invention will permit the obtained ingots to have an excellent quality with fine surface finish.

What is claimed is:

1. In a method of continuously or semi-continuously casting an ingot of rectangular cross section in a vertical open-ended direct chill mold having a coolant passageway, comprising the steps of (a) pouring molten metal into said mold, (b) providing a flow of coolant through said passageway and discharging the flow of coolant from the bottom of the mold, and (c) solidifying the poured molten metal by applying the discharged flow of coolant directly to the peripheral surface of the metal emerging from the bottom of the mold, the improvement which comprises:

a step of preventing a direct contact of said poured molten metal with an upper part of inner wall of said mold and controlling the cooling of the molten metal by said flow of coolant circulating in said passageway via said inner walls, said step of preventing the direct contact and controlling the cooling comprising interposing heat-insulating sheets between said upper part of the inner walls of the mold and the peripheral surface of the poured molten metal within the mold, said heat-insulating sheets each being dimensioned to satisfy the following formulas such that a central portion thereof extends downwardly into the mold to a greater extent than the end portions thereof:

$$0.2 \leqq V \cdot H_1 \leqq 0.7$$

$$\frac{V+0.2}{V} \leqq H_2 \leqq \frac{4V+0.7}{V}$$

$$L-1.2T \leqq L_1 \leqq L-0.6T$$

where, $V$=casting speed (cm/sec), $H_1$=distance between a lower end of said inner wall and a lower end of said heat-insulating sheet measured vertically of the mold at said central portion of the sheet on each side of the mold (cm), $H_2$=distance between said lower end of the inner wall and said lower end of the sheet measured vertically of the mold at each corner of the mold (cm), $L$=length of each long side of the mold (cm), $T$=length of each short side of the mold (cm), $L_1$=length of a lower central portion of said inner wall, not covered with said sheet, on said each long side of the mold horizontally extending with a height of $H_1$ from its center toward its ends over substantially equal lengths (cm).

2. A method as recited in claim 1, wherein said horizontal end portions of the heat-insulating sheet on said each long side of the mold are tapered at said lower end thereof downwardly of the mold from said corner to said lower central portion of the inner wall such that a vertical distance between said lower end of the inner wall and said lower end of the horizontal end portions of the sheet is changed from $H_2$ to $H_1$.

3. A method as recited in claim 1, wherein a lower central portion of said inner wall, not covered with said sheet, on said each short side of the mold horizontally extends with a height of $H_1$ from its center to its opposite ends over substantially equal lengths, a total length of extension of said lower central portion on said short side being substantially one-third of said length T.

4. A method as recited in claim 3, wherein said horizontal end portions of the heat-insulating sheet on said each short side of the mold are tapered at said lower end thereof downwardly of the mold from said corner to the opposite ends of said lower central portion of the inner wall such that a vertical distance between said lower end of the inner wall and said lower end of the horizontal end portions of the sheet is changed from $H_2$ to $H_1$.

5. A method as recited in any one of claims 1–4, wherein a horizontal distance between each of said opposite ends of said lower central portion of the inner wall on said long side and said each corner of the mold is substantially one-half of said length T.

6. A method as recited in claim 1, wherein the values T, L and V in said formulas are respectively from 300 mm to 700 mm, from 500 mm to 1600 mm and from 30 mm/min. to 100 mm/min.

7. A method as recited in claim 1, wherein said length T of the short side is not less than approximately 500 mm.

8. A method as recited in claim 1, wherein said heat-insulating sheet has a thickness in a range of 0.5–10 mm.

9. A method as recited in claim 1, wherein said molten metal is molten aluminum or aluminum-based alloy.

10. An apparatus for continuously or semi-continuously casting an ingot of rectangular cross section, which comprises:

a vertical open-ended direct chill mold having four inner walls defining a mold cavity of rectangular cross section and further having a coolant passageway partially defined by said four inner walls; and heat-insulating sheets covering upper parts of said four inner walls respectively to prevent molten metal poured into said mold cavity from directly contacting said upper parts of the inner walls and control the cooling of the poured molten metal by a flow of coolant circulating through said passageway via said inner walls, said heat-insulating sheets each being dimensioned to satisfy the following formulas:

$$0.2 \leqq V \cdot H_1 \leqq 0.7$$

$$\frac{V+0.2}{V} \leqq H_2 \leqq \frac{4V+0.7}{V}$$

$$L-1.2T \leqq L_1 \leqq L-0.6T$$

where,

V = casting speed (cm/sec.), $H_1$ = distance between a lower end of said inner wall and a lower end of said heat-insulating sheet measured vertically of the mold at said central portion of the sheet on each side of the mold (cm), $H_2$ = distance between said lower end of the inner wall and said lower end of the sheet measured vertically of the mold at each corner of the mold (cm), L = length of each long side of the mold (cm), T = length of each short side of the mold (cm), $L_1$ = length of a lower central portion of said inner wall, not covered with said sheet, on said each long side of the mold horizontally extending with a height of $H_1$ from its center toward its ends over substantially equal lengths (cm).

* * * * *